US006516163B2

(12) United States Patent
Nakai et al.

(10) Patent No.: US 6,516,163 B2
(45) Date of Patent: Feb. 4, 2003

(54) IMAGE FORMING APPARATUS HAVING CONTROL FOR FORMING DENSITY AND GRADUATION PATCHES

(75) Inventors: Tomoaki Nakai, Shizuoka (JP); Yoichiro Maebashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/940,641

(22) Filed: Aug. 29, 2001

(65) Prior Publication Data

US 2002/0041769 A1 Apr. 11, 2002

(30) Foreign Application Priority Data

Aug. 31, 2000 (JP) ..... 2000-263359

(51) Int. Cl.[7] ..... G03G 15/00
(52) U.S. Cl. ..... 399/49
(58) Field of Search ..... 399/49, 66, 72, 399/302, 308, 314

(56) References Cited

U.S. PATENT DOCUMENTS 5,565,995 A * 10/1996 Yamada et al. ..... 347/131
5,579,090 A * 11/1996 Sasanuma et al. ..... 358/521
5,842,080 A * 11/1998 Ashibe et al. ..... 399/302
6,049,681 A * 4/2000 Shiozawa et al. ..... 399/101
6,091,913 A * 7/2000 Suzuki et al. ..... 399/49
6,418,281 B1 * 7/2002 Ohki ..... 399/49
6,434,348 B1 * 8/2002 Tomizawa ..... 399/66

* cited by examiner

*Primary Examiner*—Robert Beatty
(74) *Attorney, Agent, or Firm*—Fitzpatrick, Cella, Harper & Scinto

(57) ABSTRACT

An object of the present invention is to provide an image forming apparatus that has an image bearing member, a moving member, transferring device for transferring an image formed on the image bearing member onto the moving member at a transferring position by applying a voltage thereto, and detecting device for detecting an image for density control and an image for gradation control on the moving member transferred from the image bearing member, wherein a density and gradation of the image formed on the image bearing member are controlled on the basis of a result of a detection by the detecting device, and wherein a voltage when the image for density control formed on the image bearing member is transferred onto the moving member and a voltage when the image for gradation control formed on the image bearing member is transferred onto the moving member differ from each other. In addition the image for density control is detected on the moving member before the density image passes through the transferring position, and the image for graduation control is detected on the moving member after the graduation image passes through the transferring position.

20 Claims, 7 Drawing Sheets

IMAGE FORMING APPARATUS HAVING CONTROL FOR FORMING DENSITY AND GRADUATION PATCHES

BACKGROUND OF THE INVENTION

1. Field of the Invention

This invention relates to an image forming apparatus such as a copier or a printer utilizing the electrophotographic process or the like, and particularly to an apparatus for effecting the density control and gradation control of an image formed thereby.

2. Related Background Art

With the development of the stream of an information-oriented trend, needs for handling documents and images in colors are spreading and printers of various types are on the market. As processes for forming color images, use have been made of the sublimation type, the heat transfer type, the ink jet type, etc., and to form images at a high speed, the electrophotographic type is said to be most excellent.

In an image forming apparatus of the electrophotographic type, there is the problem that image density is greatly fluctuated by the temperature and humidity under which the apparatus is used, and the unevenness or the like of the characteristics of a photosensitive member and developers. Particularly regarding color images, there arises the inconvenience that color taste is changed.

In view of these problems, in a color image forming apparatus, there is generally carried out density control in which a patch (pattern) which is an image for density control is formed in advance on a photosensitive body, an intermediate transferring member, a transferring material conveying member, a transferring material or the like, and the density thereof is detected by a density detecting sensor to thereby control image forming process conditions such as a charging bias, a developing bias and an exposure amount, and stabilize image density.

Also, in an image forming apparatus of the electrophotographic type which outputs a gradation image, the relation between an inputted image signal and the density of the output image, i.e., the gradation characteristic, generally has no linear relation, and on the low density side, density is low relative to the image signal and conversely, on the high density side, density is high relative to the image signal.

With this gradation characteristic kept intact, it is usually impossible to obtain images of a high quality of image and therefore, there is generally carried out gradation control (halftone control) in which a patch (pattern) which is an image for gradation control is tentatively formed on a photosensitive drum by a predetermined image signal, and the density of the patch is detected by a density sensor or the like, and from the result of the detection, the gradation characteristic of the image forming apparatus at that point of time is found, and on the basis thereof, a look-up table (LUT) is prepared, and the gradation characteristic is adjusted by the LUT so as to assume an appropriate relation such as a linear relation.

As density sensors used during the density control and the gradation control, a common one is usually used from the viewpoints of manufacturing cost and mounting space.

The measuring location for the patch density may be on the photosensitive body, on the intermediate transferring member, on the transferring material conveying member or on the transferring material.

However, when the density sensor is provided on the photosensitive body, the density sensor may be stained by a toner and the degree of freedom of the disposition of the density sensor is small and therefore, it is preferable to dispose the density sensor on the intermediate transferring member, the transferring material conveying member or the transferring material.

Also, the detection timing by the density sensor is the same for the density control and the gradation control, and has usually been after patches of four colors have been formed.

However, the image forming apparatus in which the above-described density control and gradation control are carried out has suffered from the following problems. Description will hereinafter be made with a four-color full color image forming apparatus comprised of an intermediate transferring member and a photosensitive drum taken as an example.

In this apparatus, when a toner image of the first color on the intermediate transferring member contacts with the photosensitive drum, part of a toner constituting the toner image is retransferred from the intermediate transferring member to the photosensitive drum. As the result, the toner image of the first color is reduced in density before transferred to the transferring material, as compared with immediately after transferred to the intermediate transferring member. Toner images of the second color and the third color, although differing in degree, are also reduced in density before transferred to the transferring material, as compared with immediately after transferred to the intermediate transferring member.

Against the above-noted problem, it will be enough if design can be made such that the retransfer becomes low by the selection of a transfer bias, but a transfer bias (transfer voltage) with which low retransfer and high transfer are compatible varies with the temperature and humidity under which the image forming apparatus is used, the unevenness of the characters of the photosensitive body and the developers, the degree of use thereof, etc. It also depends greatly on toner density (toner amount).

FIG. 7 of the accompanying drawings is a graph in which the transfer efficiency and retransfer efficiency when the transfer bias was changed are plotted. In FIG. 7, solid lines indicate the transfer efficiency, and the ratio between the toner amount MIS per unit area on the photosensitive body and the toner amount M/S when the toner image was transferred onto the intermediate transferring member is indicated in %. Dotted lines indicate the retransfer efficiency, and the ratio between the toner amount M/S on the intermediate transferring member and the toner amount M/S on the photosensitive body after the photosensitive body was contacted is indicated in %. The graph means that the higher is the retransfer efficiency, the more toner on the intermediate transferring member is transferred to the photosensitive body side. Also, the mark ● indicates a case where M/S on the photosensitive drum is as small as 0.4 $mg/cm^2$, and the mark x indicates a case where M/S on the intermediate transferring member is as great as 0.8 $mg/cm^2$.

As can be seen from FIG. 7, to satisfy high transfer efficiency at M/S=0.8 $mg/cm^2$, the transfer bias must be made high and in that case, the retransfer efficiency is high and aggravated.

During ordinary printing (image formation), the maximum M/S is of the order of 0.6 $mg/cm^2$ and therefore, use can be made of a low transfer bias which can lower the retransfer efficiency, but during the detection of the patch for density control, it is necessary to form up to a high-density patch and therefore, a transfer bias satisfy high transfer efficiency and low retransfer efficiency could not be selected.

As a method of solving the reduction in density by the retransfer of the patches for density control, the detection of the patches can be effected immediately after the transfer to thereby eliminate the influence of the retransfer, but in this case, if the detection of the patches for gradation control was effected immediately after the transfer, the following inconvenience occurred.

The patches for gradation control are formed for high toner density (toner amount to low toner density in order to grasp the gradation characteristic of the apparatus, and the toner density (toner amount) is detected, but the retransfer depends on the toner density (toner amount) and therefore, the gradation characteristic when there is the influence of the retransfer and the gradation characteristic when there is not the influence of the retransfer differ greatly from each other. To effect gradation control with good accuracy, it is necessary to detect the density of the patches for gradation control under a condition conforming to ordinary printing influenced by the retransfer or the like. Consequently, if the detection of the patches is effected immediately after the transfer to thereby eliminate the influence of the retransfer, a reduction in the accuracy with which the gradation control is effected will occur.

The foregoing description has been made with respect to a color image forming apparatus comprised of an intermediate transferring member and a photosensitive drum, and again in a color image forming apparatus in which, instead of using an intermediate transferring member, a transferring material is carried on a transferring material conveying member and conveyed to a photosensitive drum, a similar problem arises when a patch is formed on the transferring material conveying member.

Also, in recent years, because of the requirement of the market for still a higher speed of image forming apparatuses, color image forming apparatuses of the in-line type in which color forming units of four colors are juxtaposed relative to an intermediate transferring member or a transferring material conveying member have begun to be on the market. In the color image forming apparatus of this in-line type, when density control and gradation control are to be effected, it would occur to mind to provide a density sensor for the photosensitive member of each unit, but from the viewpoints of the manufacturing cost and mounting space, a density sensor is generally disposed for the intermediate transferring member or the transferring material conveying member, and again in this case, the reduction in density and the deterioration of the accuracy of gradation control by the retransfer of a patch for density control pose a problem.

This problem of retransfer, in an image forming apparatus of the in-line type wherein a cleaning apparatus for a photosensitive drum is eliminated to thereby realize a cleanerless system, results in the problem that a toner of other color is collected by a developing device due to retransfer and developers are mixed with each other in the developing device to thereby greatly deteriorate the quality of image.

SUMMARY OF THE INVENTION

It is an object of the present invention to provide an image forming apparatus which maintains the accuracy of gradation control by a patch for gradation control, and prevents any reduction in density by the retransfer of a patch for density control.

It is another object of the present invention to provide an image forming apparatus comprising an image bearing member, a moving member, transferring means for transferring an image formed on the image bearing member onto the moving member by applying a voltage thereto, and detecting means for detecting an image for density control and an image for gradation control on the moving member transferred from the image bearing member, wherein a density and gradation of the image formed on the image bearing member are controlled on the basis of a result of a detection by the detecting means, and wherein a voltage when the image for density control formed on the image bearing member is transferred onto the moving member and a voltage when the image for gradation control formed on the image bearing member is transferred onto the moving member differ from each other.

It is still another object of the present invention to provide an image forming apparatus comprising an image bearing member, a moving member, transferring means for transferring an image formed on the image bearing member onto the moving member in a transferring portion, and detecting means for detecting an image for density control and an image for gradation control on the moving member transferred from the image bearing member, wherein a density and gradation of the image formed on the image bearing member are controlled on the basis of a result of the detection by the detecting means, and wherein the image for density control is detected by the detecting means after the image for density control is transferred from the image bearing member onto the moving member and before the image for density control on the moving member passes through the transferring portion, and the image for gradation control is detected by the detecting means after the image for gradation control on the moving member transferred from the image bearing member passes through the transferring portion.

Further objects of the present invention will become apparent from the following description.

DESCRIPTION OF THE PREFERRED EMBODIMENTS

Image forming apparatuses according to the present invention will hereinafter be described in greater detail with reference to the drawings.

(Embodiment 1)

Figure 1:
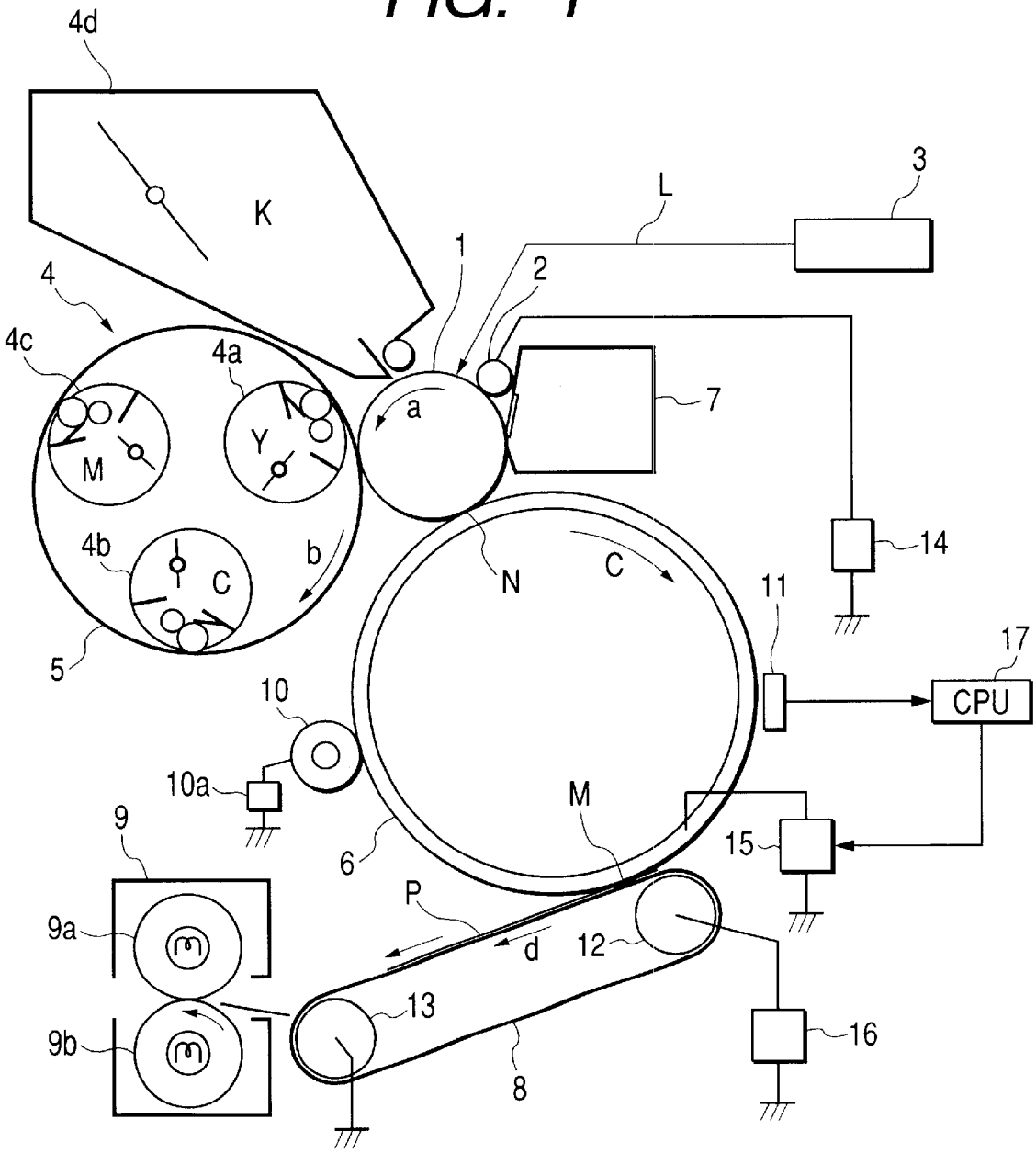
FIG. 1 is a schematic cross-sectional view showing an embodiment of the image forming apparatus of the present invention.

FIG. 1 is a schematic cross-sectional view showing an embodiment of the image forming apparatus of the present invention.

This image forming apparatus is provided with a drum-shaped electrophotographic photosensitive body, i.e., a photosensitive drum 1, as a first image bearing member, and around this photosensitive drum 1, there are disposed a charging roller 2, a developing apparatus 4, a drum-shaped intermediate transferring member, i.e., an intermediate transferring drum 6, as a second image bearing member, and a drum cleaning apparatus 7, and an exposing apparatus 3 is disposed above the photosensitive drum 1.

A secondary transferring belt 8 and an intermediate transferring member cleaning roller 10 are disposed around the intermediate transferring drum 6, and a density sensor 11 is disposed in such a manner as to be opposed to the surface of the intermediate transferring drum 6. A fixing apparatus 9 is disposed on the downstream side with respect to the conveyance direction of a transferring material P which is a recording material by the secondary transferring belt 8. The intermediate transferring drum 6 is in contact with the surface of the photosensitive drum 1 in a primary transferring nip portion N and is further in contact with the surface of the secondary transferring belt 8 in a secondary transferring nip portion M.

The photosensitive drum 1 is an OPC photosensitive drum having a diameter of 62 mm provided with an undercoat layer on the surface of an aluminum drum, a charge injection preventing layer, a charge generating layer and a charge transporting layer. The photosensitive drum 1 is rotatively driven at a predetermined peripheral speed, in the present embodiment, 100 mm/sec., in the direction of arrow a during image formation, and in the rotating process thereof, it is subjected to uniform charging of the negative polarity by the charging roller 2 to which a charging bias is applied. The charging roller 2 is rotatably in contact with the surface of the photosensitive drum 1, and in the present embodiment, a charging bias comprising an AC voltage of a sine wave of a frequency 1 kHz and a peak-to-peak voltage 2000 Vpp superimposed upon a DC voltage of −500 V is applied from a charging bias voltage source 14 to the charging roller 2, whereby the surface of the photosensitive drum 1 is charged to −500 V.

Then, the photosensitive drum 1 has its surface exposed to a laser beam L from the exposing apparatus 3, and an electrostatic latent image corresponding to a first color component image, in the present embodiment, a yellow component image, of a desired color image is formed on the surface of the photosensitive drum 1. The exposing apparatus 3 is comprised of a laser driver, a laser diode, a polygon mirror, etc., not shown, and the time-series electrical digital image signal of image information is inputted to the laser driver, and a laser beam modulated correspondingly to the image signal is outputted from the laser diode, and the laser beam L is scanned by the polygon mirror rotated at a high speed, and the surface of the photosensitive drum 1 is exposed thereto through the intermediary of a reflecting mirror, not shown, whereby an electrostatic latent image of each color corresponding to the image information is formed on the surface of the photosensitive drum 1.

This electrostatic latent image is developed by the yellow developing device 4*a* of the developing apparatus 4 under the application of a developing bias comprising a rectangular wave AC voltage of a frequency 2000 Hz and a peak-to-peak voltage (Vpp) of 2000 V, and is visualized as a yellow toner image.

The developing apparatus 4 is provided with monocomponent developing devices 4*a,* 4*b* and 4*c* containing yellow (Y), magenta (M) and cyan (C) non-magnetic toners, respectively, therein, and a magnetic monocomponent developing device 4*d* containing a black (K) magnetic toner therein. In the present embodiment, the developing devices 4*a,* 4*b* and 4*c* use a yellow toner, a magenta toner a cyan toner which are spherical non-magnetic toners (non-magnetic toners containing no magnetic material) of a capsule type including wax manufactured by the polymerizing method. The developing device 4*d* uses a magnetic toner having a particle diameter of 6 $\mu$m manufactured by the crushing method and the spheroidizing process with 100 parts of magnetite, a charge controlling agent, a lubricant, etc. internally added to a polyester binder. These toners are all negative toners of negative chargeability.

The yellow developing device 4*a,* the magenta developing device 4*b* and the cyan developing device 4*c* are carried on a rotary member 5, and during development, by the rotation of the rotary member 5 in the direction of arrow b (clockwise direction) by a rotatively driving device (not shown), they are successively disposed at a developing position opposed to the photosensitive drum 1, and are used for development. The black developing device 4*d* is stationarily disposed relative to the photosensitive drum 1, and is used for development at that position.

The intermediate transferring drum 6 comprises an aluminum drum which is a mandrel, and an elastic resistance layer formed on the outer peripheral surface thereof and having a thickness of 5 mm and formed of rubber of medium resistance, and having its surface coated with fluorine resin for securing the mold releasing property. The rubber material comprises a mixture of NBR and ethylene oxide, and has its volume resistivity made as low as $10^7$ Ωcm by the ethylene oxide. The fluorine resin coating the surface has volume resistivity of $10^{14}$ Ωcm.

The volume resistivity of the intermediate transferring drum 6 was found by bringing a metallic drum having a diameter of 62 mm into contact with the entire lengthwise surface of the intermediate transferring drum 6 with a nip width of 7 mm, and converting from an electric current measured with a voltage of 1000 V applied to therebetween.

In the present embodiment, the largest sheet size that can be supplied in the image forming apparatus is A3, and the intermediate transferring drum 6 is formed to a diameter of 186 mm, and has such a circumferential length as can bear an image corresponding to a transferring material of A3. The intermediate transferring drum 6 is rotatively driven in the direction of arrow c. A primary transferring bias voltage source 15 is connected to this intermediate transferring drum 6, and during the primary transfer to the intermediate transferring drum 6, a predetermined primary transferring bias of the opposite polarity to the toners, in the present embodiment, +300 V, is applied from the voltage source 15 to the mandrel of the intermediate transferring drum 6.

The yellow toner image formed on the photosensitive drum 1 is primary-transferred onto the surface of the intermediate transferring drum 6 by the pressure in the primary transferring nip portion N and an electric field formed by the potential difference between +300 V applied to the intermediate transferring drum 6 and the surface potential of the photosensitive drum 1, in the process of passing through the primary transferring nip portion N between the photosensitive drum 1 and the intermediate transferring drum 6 with the rotation of the photosensitive drum 1.

The photosensitive drum 1 from which the primary transfer of the yellow toner image has been completed has any untransferred toner residual on its surface removed by the drum cleaning apparatus 7, and is used for the next magenta image formation.

Thereafter, in the same manner, with respect to magenta, cyan and black, the charging of the photosensitive drum 1 by the charging roller 2, the latent image formation by the exposure by the exposing apparatus 3, the development by the developing devices 4*b*, 4*c* and 4*d*, and the transfer to the intermediate transferring drum 6 are effected, whereby a composite color image comprising toner images of four colors corresponding to a desired color image and superimposed one upon another is formed on the intermediate transferring drum 6. The composite color image on the intermediate transferring drum 6 is collectively secondary-transferred to a transferring material P conveyed while being electrostatically attracted to the secondary transferring belt 8.

The secondary transferring belt 8 is passed over a transferring roller 12 and a driving roller 13, and by the rotative driving of the driving roller 13, it is rotated in such a direction that the upper track of the belt 8 moves in the direction of arrow d. This secondary transferring belt 8 is movable toward and away from the intermediate transferring drum 6, and rocks and contacts with the intermediate transferring drum 6 at the timing whereat the transferring material P passes the supply path to the secondary transferring nip portion M. The transferring material P is supplied to the secondary transferring nip portion M at the timing whereat the leading end of the composite color image on the intermediate transferring drum 6 comes to the secondary transferring nip portion M.

The secondary transferring belt 8 comprises an electrically conductive urethane belt as a base, and has a coating of PVDF having a thickness of 30 $\mu$m applied to the surface of the urethane belt to thereby make the electrostatic capacity thereof great in order to make the electrostatic attraction of the transferring material P to the surface of the secondary transferring belt 8 possible. The resistance value measured with a voltage of 1000 V applied to between an area of 10 $cm^2$ on the surface of the belt and the base of the belt was $10^{10}$ Ω.

The secondary transferring roller 12 and the driving roller 13 are rubber rollers of low resistance, and the impedance of the secondary transferring belt 8 substantially depends on only the resistance of the surface layer of the secondary transferring belt 8. A secondary transferring bias voltage source 16 is connected to the secondary transferring roller 12, and the secondary transferring bias of a transferring current +20 $\mu$A is applied from the voltage source 16 to the secondary transferring belt 8, whereby the toner images of four colors on the intermediate transferring drum 6 are secondary-transferred to the transferring material P on the transferring belt 8.

The secondary-untransferred toners residual on the intermediate transferring drum 6 by the secondary transfer are charged to the opposite polarity (positive polarity) to the original charging polarity by the intermediate transferring member cleaning roller 10 to which a cleaning bias is applied. The cleaning roller 10 is installed for movement toward and away from the intermediate transferring drum 6, and has connected thereto a bias voltage source 10*a* for applying a cleaning bias thereto. The secondary-untransferred toners charged to the opposite polarity are carried to the primary transferring nip portion N with the rotation of the intermediate transferring drum 6, and electrostatically shift to the photosensitive drum 1 simultaneously with the primary transfer of the toner images from the photosensitive drum 1 to the intermediate transferring drum 6, and are removed from the intermediate transferring drum 6. The toners having shifted to the photosensitive drum 1 are removed and collected by the drum cleaning apparatus 7.

The transferring material P to which the toner images of four colors have been transferred is conveyed to the fixing apparatus 9 by the secondary transferring belt 8 and is subjected to fixing. The fixing apparatus 9 has a fixing roller 9*a* rotated and containing a heater therein, and a pressure roller 9*b* containing a heater therein and contacting with and driven to rotate by the fixing roller 9*a*, and the transferring material P to which the toner images have been transferred is conveyed while being nipped by the contact nip portion (fixing nip portion) between these rollers 9*a* and 9*b*, and the transferring material P is heated and pressurized to thereby fix the toner images and provide a full color fixed image.

Density control and gradation control in the above-described full color image formation will now be described.

Figure 2:
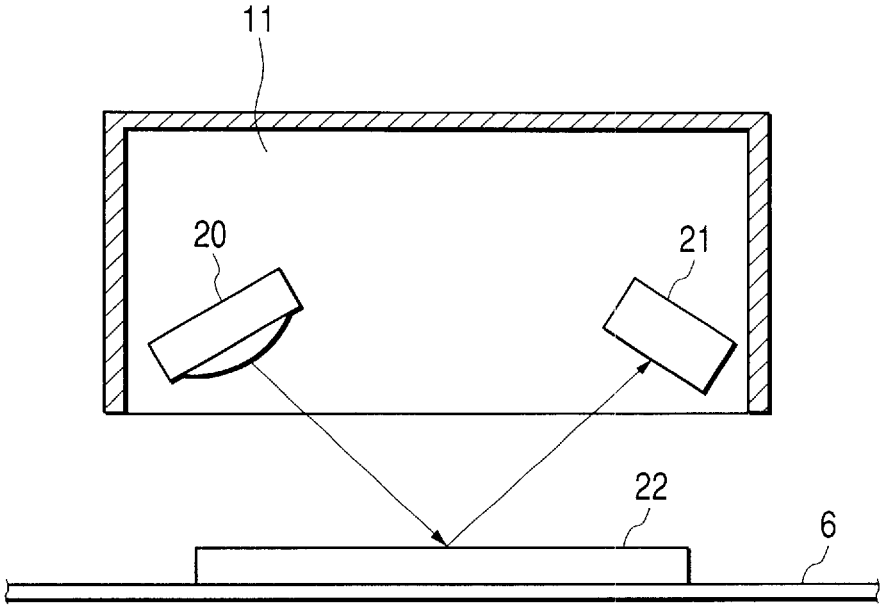
FIG. 2 is a schematic view showing a density sensor used in the image forming apparatus of FIG. 1.

The density sensor 11, as shown in FIG. 2, is provided with a light emitting portion 20 and a light receiving portion 21, and applies a spot light from the light emitting portion 20 to a patch 22 which is a detection image for density control or gradation control formed on the surface of the intermediate transferring drum 6, and receives the reflected light from the patch 22 by the light receiving portion 21, and detects the density of the patch 22 by the quantity of received light.

The density detection signal from the light receiving portion 21, as shown in FIG. 1, is inputted to a control device (CPU) 17, which thus changes a condition regarding the density of the image, for example, an image forming condition such as the developing bias of the developing apparatus 4, on the basis of the density detection signal of the patch for density control, and controls the density of the image so as to become appropriate, and changes a condition regarding the halftone of the image, i.e., a halftone correcting condition, on the basis of the density detection signal of the patch for gradation control, and controls the halftone of the image so as to become appropriate.

The density control is effected as follows. The density control is started at suitable timing such as during the closing of the power supply switch of the main body of the apparatus, or after the lapse of a predetermined time from after the closing of the power supply switch, on the point of time at which the number of developed sheets has reached a predetermined number.

Figure 3:
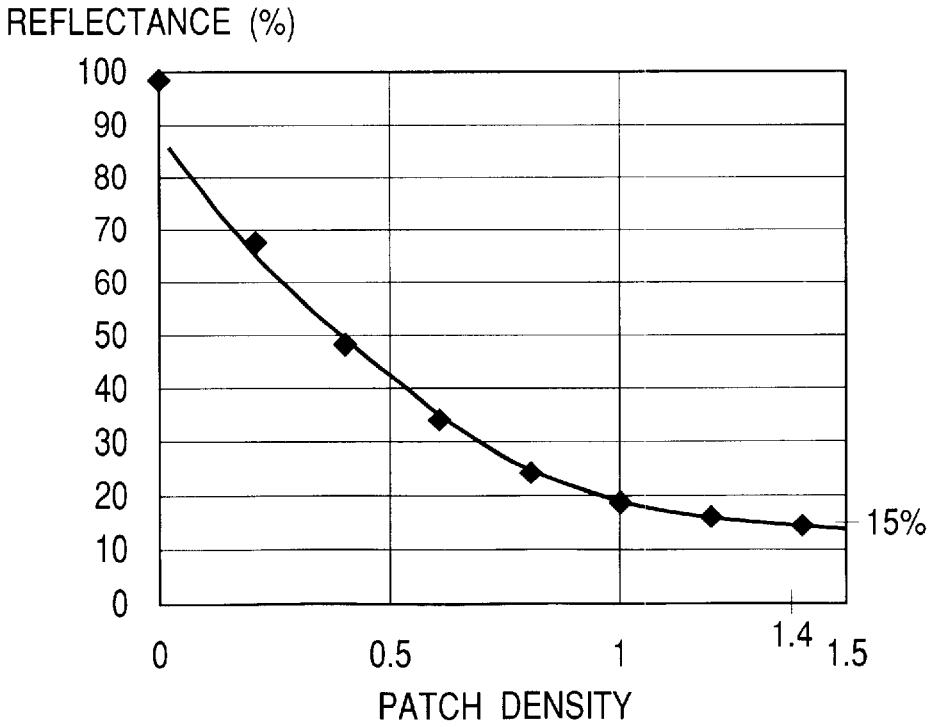
FIG. 3 is a graph showing the relation between patch density and reflectance.

FIG. 3 is a graph showing the relation between the patch density and reflectance. The reflectance was measured about the patches on the intermediate transferring drum 6, and the quantity of light incident on the light receiving portion 21 in the absence of the patches was used as the reference, and this was defined as 100%. The density was measured about the patches transferred onto the transferring material.

When there is no patch, i.e., no toner, on the intermediate transferring drum 6, the reflectance is 100%, but when the toner amount of (on) the patches increases, the light applied from the light emitting portion 20 decreases in the quantity of regularly reflected light incident on the light receiving portion 21 and is reduced in reflectance, because the diffused amount by the toner increases. To find the toner density of the patches on the transferring material from the reflectance of the patches on the intermediate transferring drum, a density conversion table can be used.

Figure 4:
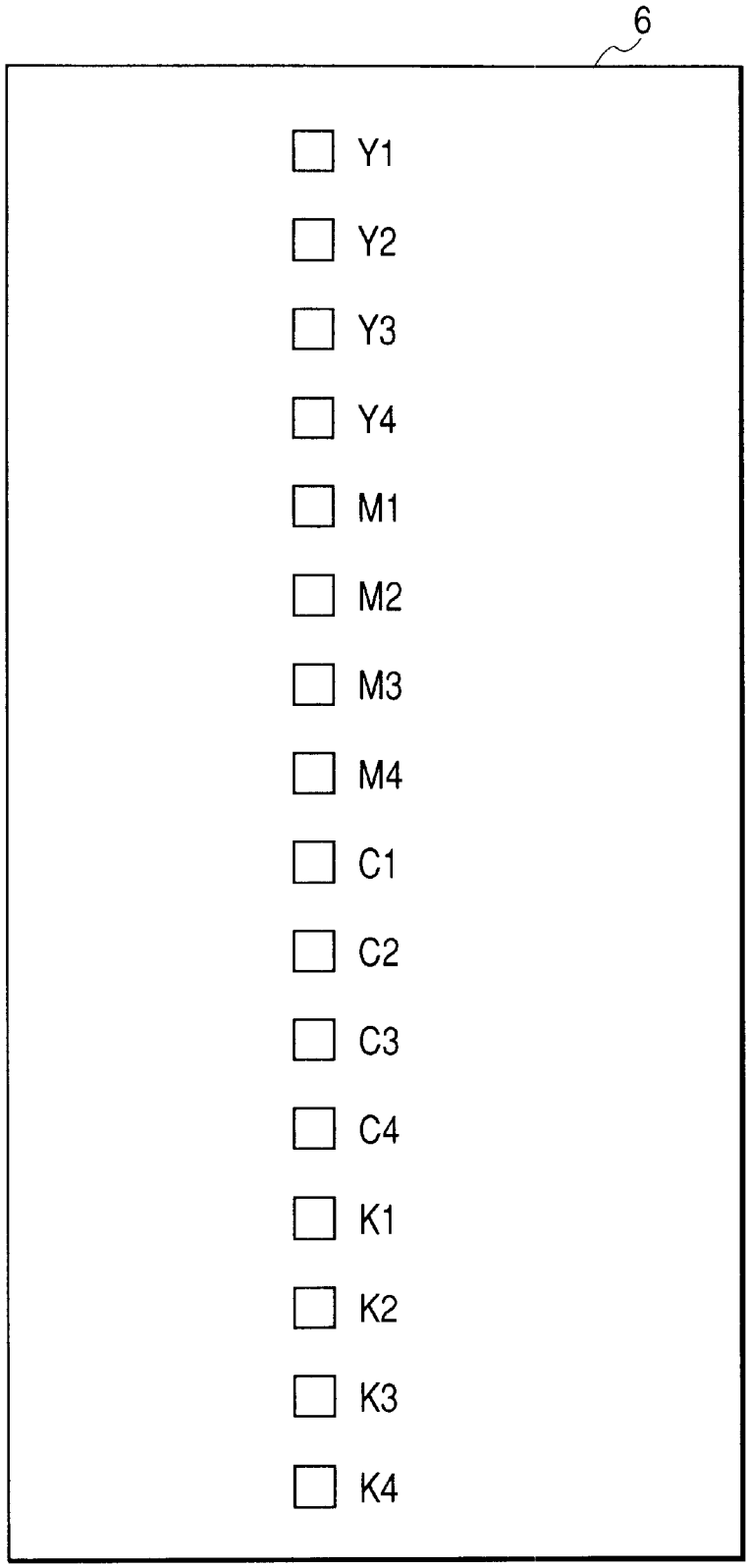
FIG. 4 is a typical view showing an intermediate transferring drum on which patches for density control are formed as it is developed circumferentially thereof.

FIG. 4 is a typical view showing the intermediate transferring drum 6 on which patches for density control are formed as it is developed circumferentially thereof, and Y1, Y2, Y3 and Y4 designate yellow patches formed by developing patch latent images with the developing bias changed to four stages, i.e., −100 V, −150 V, −200 V and −250 V, and transferring them to the intermediate transferring drum 6. M1–M4 denote magenta patches formed in the same manner, C1–C4 designate cyan patches, and K1–K4 denote black patches. As described above, the patches for density control are a plurality of images corresponding to the plurality of colors, and the respective colors do not overlap one another on the intermediate transferring drum 6.

Figure 5:
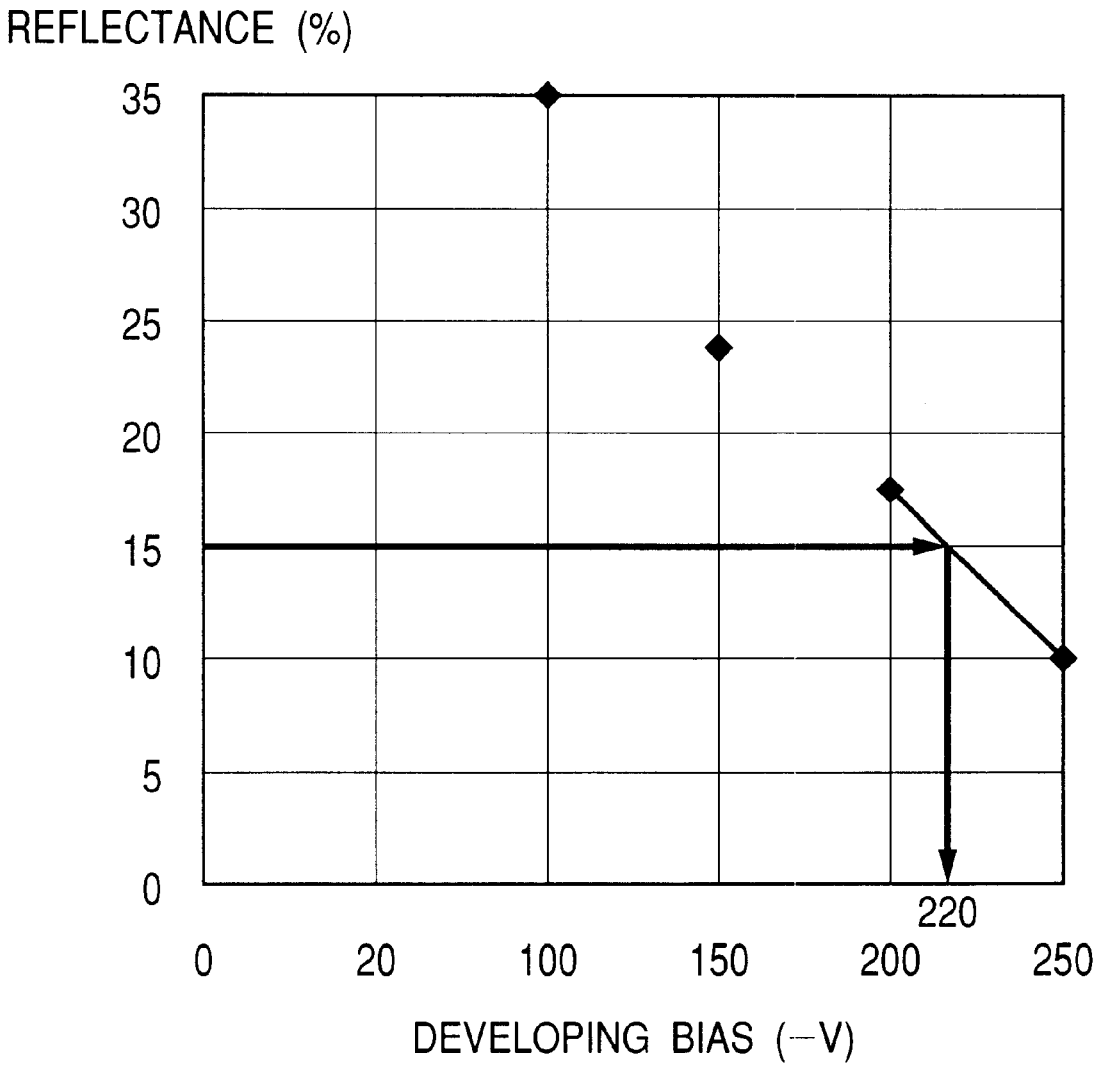
FIG. 5 is a graph showing the relation between a developing bias for the patches and reflectance.

FIG. 5 is a graph showing the relation between the developing bias and reflectance on the above-described yellow patches. In the present embodiment, the developing bias is set so that the patch density on the transferring material may be 1.4. It will be seen from FIG. 3 that the patch density 1.4 corresponds to the reflectance 15%, and it will be seen from FIG. 5 that finding the developing bias when the reflectance is 15% between a developing bias of −200 V and a developing bias of −250 V by linear interpolation, the developing bias for obtaining density 1.4 is −220 V. With respect also to magenta, cyan and black, the developing bias for density 1.4 can be found in the same manner.

As described above, by controlling the developing bias which is one of the image forming conditions as the condition regarding the density of the image, stable image density can be secured irrespective of the fluctuations by environment and use.

The gradation control will now be described. The gradation control is also started at suitable timing such as during the closing of the power supply switch of the main body of the apparatus, or after the lapse of a predetermined time from after the closing of the power supply switch, or the point of time at which the number of developed sheets has reached a predetermined number.

Figure 6:
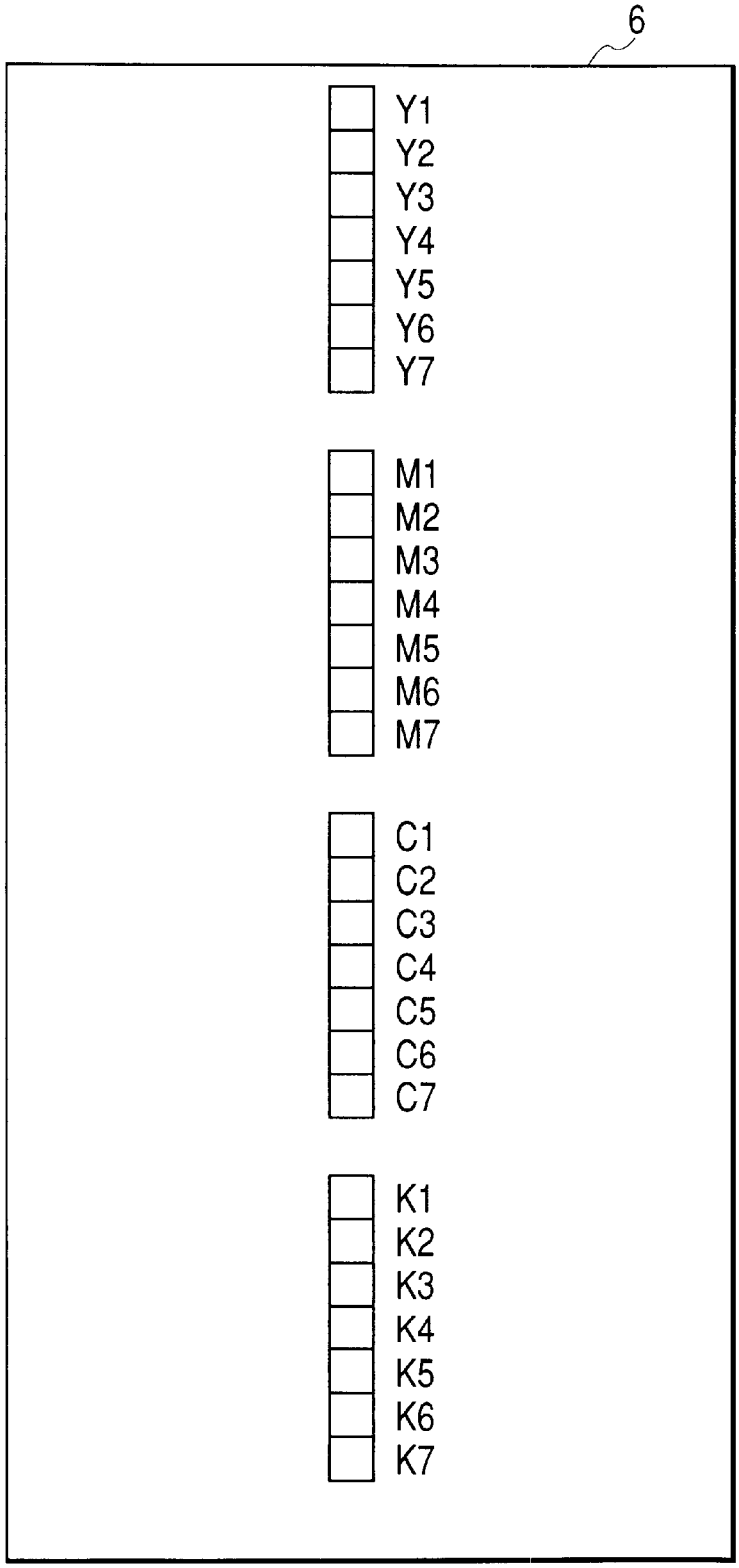
FIG. 6 is a typical view showing the intermediate transferring drum on which patches for gradation control are formed as it is developed circumferentially thereof.
Figure 7:
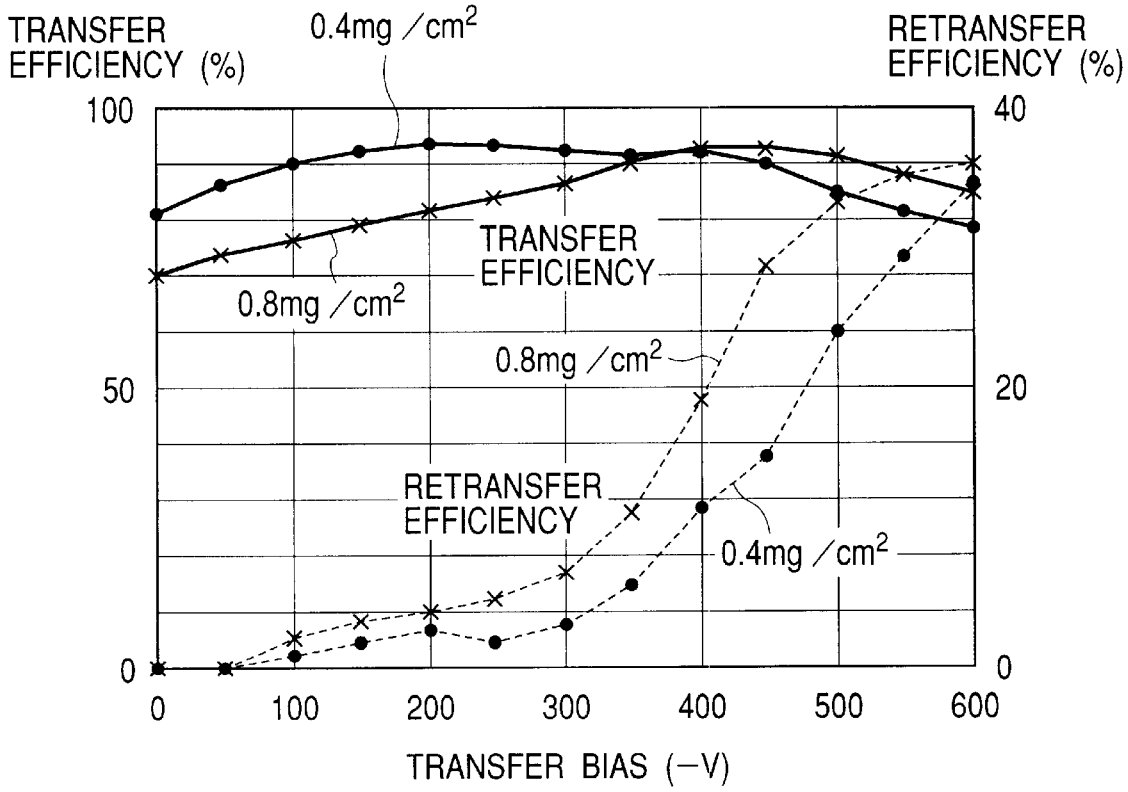
FIG. 7 is a graph showing the relations among a transfer bias and transfer efficiency and retransfer efficiency.

FIG. 6 is a typical view showing the intermediate transferring drum 6 on which patches for gradation control are formed as it is developed circumferentially thereof, and Y1, Y2, Y3, Y4, Y5, Y6 and Y7 designate yellow patches formed by being transferred to the intermediate transferring drum 6. Y1 is for the lowest density, and Y7 is for the highest density, and the density becomes gradually higher from Y1 toward Y7.

These yellow patches Y1–Y7 were obtained by reading out image data corresponding thereto from a ROM (not shown) pre-storing them therein, delivering these image data to the laser driver of the exposing apparatus 3, forming seven stages of patch latent images by exposure, and developing these by the same developing bias. M1–M7 denote magenta patches for gradation control in which the density is likewise changed to seven stages, C1–C7 designate cyan patches, and K1–K7 denote black patches. As described above, the patches for gradation control are a plurality of images corresponding to the plurality of colors, and the respective color do not overlap one another on the intermediate transferring drum 6.

The density of the patches Y1–Y7 formed on the intermediate transferring drum 6 is measured at suitable timing by the density sensor 11, and the measured density of the patches Y1–Y7 is preserved in a RAM, not shown, while on the other hand, LUT for gradation correction for correcting the condition regarding the halftone of yellow is prepared on the basis of the measured density of the patches Y1–Y7. This also holds true of magenta and cyan. During image formation, the gradation correction (halftone control) of each color can be effected on the basis of the LUT for each color. The order of the colors may be arbitrary.

In the present embodiment, the detection timing of the patches is the same for the density control and the gradation control, and is after the patch images of the four colors have been formed on the intermediate transferring member.

So, in the present embodiment, in order to maintain the accuracy of the gradation control (halftone control) by the patches for gradation control, and in the density control by the patches for density control, in order to prevent the reduction in density by retransfer and improve the accuracy of the density control, the condition of the transferring bias voltage is made different between the transfer of the patches for gradation control to the intermediate transferring member and the transfer of the patches for density control to the intermediate transferring member.

More particularly, regarding the patches for gradation control, the accuracy of the gradation control of halftone was maintained as the transferring bias voltage (in the present embodiment, 300 V as previously mentioned) conforming to the transfer during ordinary image formation.

In the gradation control, it is the purpose to obtain a desired gradation characteristic, and the patch density for gradation control can be detected in a state conforming to the ordinary printing affected by retransfer or the like, and the problem of retransfer need not particular be taken into consideration. Also, this gradation control is generally effected after the density control is effected to make a solid image (M/S is greatest) proper and therefore, even in a cleanerless image forming apparatus of the above-described in-line type, the occurrence of retransfer due to the image toner amount being great is suppressed and therefore, in the gradation control, no problem arises particularly about the quality of image.

Regarding the patches for density control, the transferring bias voltage when the patches for density control are transferred to the intermediate transferring member is made high and the transferring bias voltage when the transferred patches for density control contact with the image bearing member is made low to thereby prevent the reduction in density due to retransfer and improve the accuracy of the density control.

In order to carry out this, as shown in FIG. 1, the primary transferring bias voltage source 15 is connected to the aforementioned control device 17, and the primary transferring bias voltage generated by the voltage source 15 is controlled by the control device 17 so that the primary transferring bias voltage applied from the voltage source 15 to the mandrel of the intermediate transferring drum 6 can be changed.

In the present embodiment, there was carried out the test of evaluating how the transfer efficiency and the patch density affected by retransfer would become when the primary transferring bias voltage source 15 was controlled by the control device 17 and the transferring bias voltage during the transfer of the patches for density control was changed (Embodiment 1) and when it was not changed (comparative examples). The conditions of the transferring bias voltage and such result as patch density in Embodiment 1 and Comparative Examples 1 to 4 are shown in Table 1 below.

TABLE 1

| | Density | Transferring Bias | Remarks |
|---|---|---|---|
| Embodiment 1 | 1.26 | 400 V during transfer of patches<br>OV when the patches on the intermediate transferring member contact with the photosensitive drum | Transfer efficiency is high.<br>Retransfer is little. |
| Comparative Example 1 | 0.84 | constant at OV | Transfer efficiency is low. |
| Comparative Example 2 | 1.02 | constant at 200 V | Transfer efficiency is low. |
| Comparative Example 3 | 1.12 | constant at 400 V | Retransfer is much. |
| Comparative Example 4 | 0.96 | constant at 600 V | Retransfer is much. |

As shown in Table 1, in the present embodiment, the primary transferring bias voltage during the transfer of the patches to the intermediate transferring drum was as high as 400V and the transferring bias voltage when the patches on the intermediate transferring drum contacted with the photosensitive drum was as low as 0V and therefore, high transfer efficiency was maintained and yet retransfer could be made little, and a reduction in patch density could be prevented.

In contrast, in Comparative Example 1, both of the primary transferring bias voltage during the transfer of the patches and the transferring bias voltage when the patches on the intermediate transferring drum contacted with the photosensitive drum were as low as 0V, and in Comparative Example 2, both of the primary transferring bias voltage and the transferring bias voltage when the patches on the intermediate transferring drum contacted with the photosensitive drum were as low as 200V and therefore, in both examples, transfer efficiency was low and the patch density lowered.

Also, in Comparative Example 3, both of the primary transferring bias voltage and the transferring bias voltage when the patches contacted with the photosensitive drum were as high as 400V, and in Comparative Example 4, both of the primary transferring bias voltage during the transfer of the patches and the transferring bias voltage when the patches on the intermediate transferring drum contacted with the photosensitive drum were as high as 600V and therefore, in both examples, the amount of occurrence of retransfer was great and a reduction in the density of the patches occurred.

As described above, in the present embodiment, the primary transferring bias voltage during the transfer of the patches for density control was changed so as to be high, that is, higher than the transferring bias voltage when the patches for gradation control were transferred, and the transferring bias voltage when the patches transferred to the intermediate transferring drum contacted with the photosensitive drum was changed so as to be low, that is, lower than the transferring bias voltage during the transfer of the patches for density control to the intermediate transferring drum, and therefore the transfer efficiency can be maintained high and yet the retransfer can be made little, and the patch density free of a reduction in density can be detected. Accordingly, density control can be effected on the basis of patch density detection to thereby improve the accuracy of the density control. In the present embodiment, the transferring bias voltage when the patches transferred to the intermediate transferring drum contact with the photosensitive drum is 0V, which is lower than the bias voltage when the patches for gradation control are transferred (the bias voltage during ordinary image formation).

On the other hand, with regard to the gradation control, there is no problem even if there is retransfer with regard to the patches for gradation control and accordingly, in the present embodiment, with the transferring bias of the patches for gradation control as a condition conforming to the transfer during ordinary image formation, the patches for gradation control are formed well on the intermediate transferring member and the density of those patches is detected and gradation control is effected, whereby the accuracy of the gradation control (halftone control) can be maintained.

As described above, according to the present embodiment, the detection timing for the patches is the same for the density control and the gradation control and even after retransfer, the transferring bias voltage during the density control can be changed to thereby detect each patch density with good accuracy.

(Embodiment 2)

Another embodiment of the present invention will now be described.

This embodiment is characterized in that the timing for detecting the patches for density control is immediately after the patches for density control have been transferred from the photosensitive drum 1 to the intermediate transferring drum 6, that is, before the patches arrive at the primary transferring nip portion N, while on the other hand, the timing for detecting the density of the patches for gradation control, as during ordinary printing, is after the patches for gradation control of black which is the last, i.e., fourth color, have been transferred onto the intermediate transferring drum 6.

An evaluation test for confirming the effect of the present embodiment was carried out by the use of the image forming apparatus described in Embodiment 1. The evaluation item is the reduction in density by the retransfer with regard to the yellow patches for density control, and in the present embodiment, the density of the yellow patches was detected immediately after the transfer thereof to the intermediate transfer drum 6. On the other hand, in the comparative examples, the detection of the density of the yellow patches was effected immediately after the last color, i.e., black, patches were transferred to the intermediate transferring drum 6. In the case of the comparative examples, the yellow patches contact with the photosensitive drum 1 three times in total from after they are transferred to the intermediate transferring drum 6 till the density detection.

As the result, in the present embodiment, yellow patch density of 1.32 was obtained, whereas in the comparative examples, lower yellow patch density of 1.18 was obtained.

As described above, the density detecting timing for the patches for density control is put immediately after the patches have been transferred from the photosensitive drum 1 to the intermediate transferring drum 6, whereby the influence of retransfer can be eliminated to thereby improve the accuracy of the density control.

As regards the gradation control, the accuracy of halftone control can be maintained by making the transferring bias of the patches for gradation control conform to the transfer during ordinary image formation.

Again in the present embodiment, during the density control, in order to obtain high transfer efficiency in the primary transferring portion, the transferring bias voltage may be made higher than the transferring bias voltage during ordinary image formation.

While in each of the above-described embodiments, there has been shown a case where patches for density control and patches for gradation control of a plurality of colors formed on the image bearing member are transferred to the intermediate transferring member, and the patch density is detected on the intermediate transferring member by the density detecting means installed in opposed relationship with the intermediate transferring member, the present invention can also be applied to a case where in an image forming apparatus having a transferring material conveying member such as a transferring belt like the belt 8 of FIG. 1, the patches are transferred to the transferring material conveying member and the patch density is detected on the transferring material conveying member by density detecting means installed in opposed relationship with the transferring material conveying member, and a similar effect can be obtained.

Figure 8:
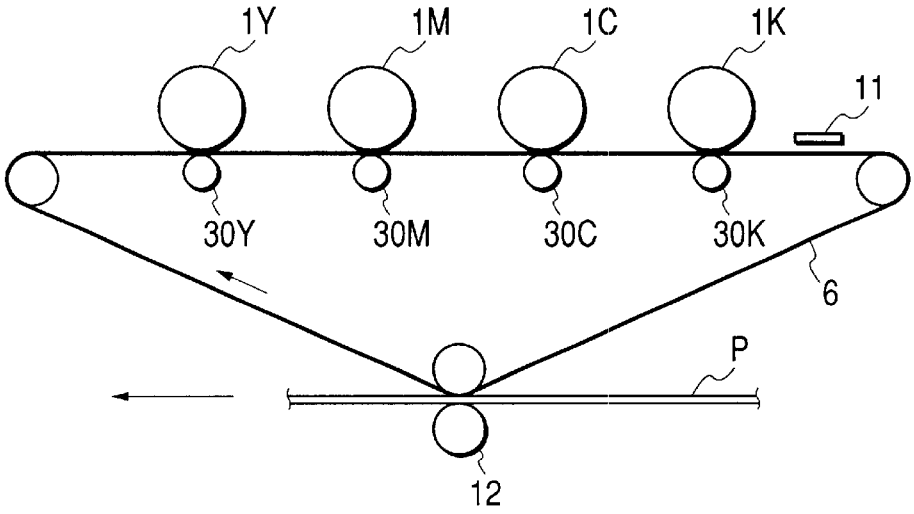
FIG. 8 shows another image forming apparatus to which the present invention is applicable.
Figure 9:
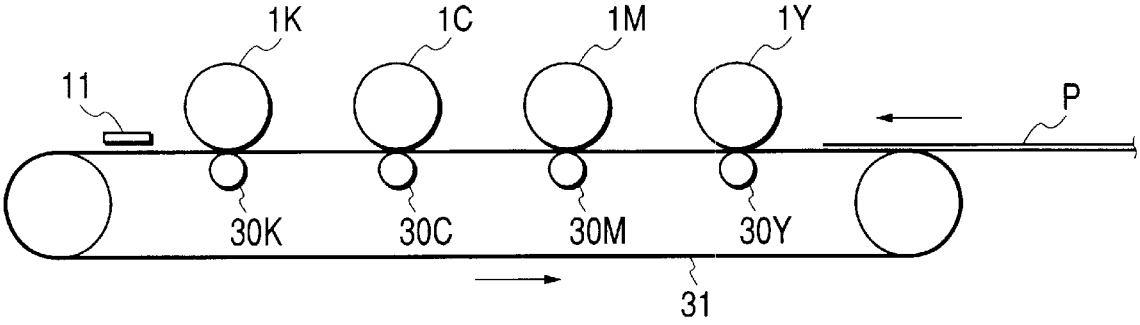
FIG. 9 shows another image forming apparatus to which the present invention is applicable.

The present invention can further be applied to an image forming apparatus of the in-line type as shown in FIGS. 8 and 9 wherein a plurality of image bearing members 1Y, 1M, 1C and 1K are juxtaposed relative to an intermediate transferring member or a transferring material conveying member, and by applying the present invention also to a case where patches for density control and patches for gradation control of a plurality of colors formed on the plurality of image bearing members are transferred to the intermediate transferring member 6 or the transferring material conveying member 31 by primary transferring rollers 30Y, 30M, 30C and 30K, and the patch density is detected on the intermediate transferring member or the transferring material conveying member by density detecting means 11 installed in opposed relationship with the intermediate transferring member or the transferring material conveying member, an effect similar to that of the above-described embodiment can be obtained.

In the present invention, the location for measuring the patch density can be on the intermediate transferring member, on the transferring material conveying member or on the transferring material.

However, in a case where the patch density is measured on the transferring material, extra transferring materials become necessary correspondingly to the patches to be formed thereon, and after the density control and gradation control, it is necessary for a user to take the trouble to dispose of the transferring materials which have become unnecessary.

On the other hand, a cleaning apparatus for removing any untransferred toner is installed for the intermediate transferring member and the transferring material conveying member and therefore, when the patch density is to be measured on the photosensitive body, the intermediate transferring member and the transferring material conveying member, the patches on the photosensitive body, the patches on the intermediate transferring member and the patches on the transferring material conveying member can be cleaned by the cleaning apparatus after the density control and the gradation control, and the user is not troubled.

Accordingly, it is preferable that the density sensor be installed relative to the intermediate transferring member and the transferring material conveying member.

While the embodiments of the present invention have been described above, the present invention is not restricted to the above-described embodiments, but all modifications are possible within the technical idea of the present invention.

What is claimed is:

1. An image forming apparatus comprising:

an image bearing member;

a moving member;

transferring means for transferring an image formed on said image bearing member onto said moving member by applying a voltage thereto; and detecting means for detecting an image for density control and an image for gradation control on said moving member transferred from said image bearing member;

wherein a density and gradation of the image formed on said image bearing member are controlled on the basis of a result of a detection by said detecting means, and wherein a voltage when said image for density control formed on said image bearing member is transferred onto said moving member and a voltage when said image for gradation control formed on said image bearing member is transferred onto said moving member differ from each other.

2. An image forming apparatus according to claim 1, wherein the voltage when the image for density control formed on said image bearing member is transferred onto said moving member is greater than the voltage when the image for gradation control formed on said image bearing member is transferred onto said moving member.

3. An image forming apparatus according to claim 1, wherein each of said image for density control and said image for gradation control includes a plurality of images corresponding to a plurality of colors.

4. An image forming apparatus according to claim 3, wherein both of said image for density control and said image for gradation control are detected by said detecting means after all the plurality of images have been transferred onto said moving member.

5. An image forming apparatus according to claim 4, wherein in each of said image for density control and said image for gradation control, all of the plurality of images transferred onto said moving member except the image transferred lastly onto said moving member contact with said image bearing member.

6. An image forming apparatus according to claim 1, wherein the voltage when the image for density control formed on said image bearing member is transferred onto said moving member and a voltage when the image for density control transferred onto said moving member contacts with said image bearing member differ from each other.

7. An image forming apparatus according to claim 6, wherein the voltage when the image for density control formed on said image bearing member contacts with said image bearing member is smaller than the voltage when the image for density control formed on said image bearing member is transferred onto said moving member.

8. An image forming apparatus according to claim 1, wherein said moving member is an intermediate transferring member.

9. An image forming apparatus according to claim 1, wherein said moving member is a transferring material conveying member for conveying a transferring material.

10. An image forming apparatus according to claim 8, wherein said image for density control and said image for gradation control are transferred onto said moving member via a transferring material.

11. An image forming apparatus according to claim 1, wherein said image bearing member includes a plurality of image bearing members corresponding to a plurality of colors.

12. An image forming apparatus comprising:

an image bearing member;

a moving member;

transferring means for transferring an image formed on said image bearing member onto said moving member in a transferring portion; and detecting means for detecting an image for density control and an image for gradation control on said moving member transferred from said image bearing member;

wherein a density and gradation of the image formed on said image bearing member are controlled on the basis of a result of the detection by said detecting means, and wherein said image for density control is detected by said detecting means after said image for density control is transferred from said image bearing member onto said moving member and before said image for density control on said moving member passes through said transferring portion, and said image for gradation control is detected by said detecting means after the image for gradation control on said moving member transferred from said image bearing member passes through said transferring portion.

13. An image forming apparatus according to claim 12, wherein each of said image for density control and said image for gradation control includes a plurality of images corresponding to a plurality of colors.

14. An image forming apparatus according to claim 13, wherein said image for density control is detected before all the plurality of images pass through said transferring portion, and said image for gradation control is detected after all of the plurality of images except the image transferred lastly onto said moving member passed through said transferring portion.

15. An image forming apparatus according to claim 12, wherein said moving member is an intermediate transferring member.

16. An image forming apparatus according to claim 12, wherein said moving member is a transferring material conveying member for conveying a transferring material.

17. An image forming apparatus according to claim 16, wherein said image for density control and said image for gradation control are transferred onto said moving member via the transferring material.

18. An image forming apparatus according to claim 12, wherein said image bearing member includes a plurality of image bearing members corresponding to a plurality of colors.

19. An image forming apparatus according to claim 12, wherein said transferring means transfers the image formed on said image bearing member onto said moving member by applying a voltage thereto, and a voltage when the image for density control formed on said image bearing member is transferred onto said moving member and a voltage when the image for gradation control formed on said image bearing member is transferred onto said moving member differ from each other.

20. An image forming apparatus according to claim 19, wherein the voltage when the image for density control formed on said image bearing member is transferred onto said moving member is greater than the voltage when the image for gradation control formed on said image bearing member is transferred onto said moving member.

* * * * *